United States Patent [19]

Newman

[11] Patent Number: 4,776,387

[45] Date of Patent: Oct. 11, 1988

[54] HEAT RECUPERATOR WITH CROSS-FLOW CERAMIC CORE

[75] Inventor: Ray L. Newman, Towanda, Pa.

[73] Assignee: GTE Products Corporation, Stamford, Conn.

[21] Appl. No.: 533,468

[22] Filed: Sep. 19, 1983

[51] Int. Cl.[4] ..... F28F 3/00; F28F 7/00

[52] U.S. Cl. ..... 165/76; 165/82; 165/166

[58] Field of Search ..... 165/67, 69, 81, 82, 165/166, 76

[56] References Cited

U.S. PATENT DOCUMENTS

| | | | |
|---|---|---|---|
| 4,083,400 | 4/1978 | Dziedzic et al. | 165/82 X |
| 4,328,860 | 5/1982 | Hoffmuller | 165/81 |
| 4,333,522 | 6/1982 | Brune | 165/69 |

*Primary Examiner*—Allen M. Ostrager

*Attorney, Agent, or Firm*—James Theodosopoulos

[57] ABSTRACT

A heat recuperator comprises a cross-flow ceramic core within a housing. Of the six faces on the core, four have openings for gas flow therethrough and two faces are solid. Means are provided to apply compressive force to the solid faces, the means being disposed within the housing.

2 Claims, 2 Drawing Sheets

HEAT RECUPERATOR WITH CROSS-FLOW CERAMIC CORE

This invention concerns heat recuperators having cross-flow ceramic cores. Such recuperators are shown in U.S. Pat. Nos. 4,083,400, 4,130,160, 4,279,297, 4,300,627 and 4,362,209. Each core is comprised of ceramic ribbed layers, the spaces between ribs providing channels for the flow of gases therethrough. Alternate layers are orthogonal to each other, as shown in FIG. 1 of U.S. Pat. No. 4,130,160 and FIG. 3 of U.S. Pat. No. 4,300,627, in order to provide cross flow. Thus, of the three pairs of faces on the core, one pair provides for the passage through the core of the gas to be heated, typically, air for combustion. A second pair of faces provides for the passage through the core of hot exhaust gases. The third pair of faces is solid, that is to say, there are no openings therein for gas flow.

In the assembly of a core within a housing, the air inlet face of the core is aligned with the air inlet opening or conduit of the housing. In the passage of the air from the housing conduit into the channel openings on the air inlet face of the core, it is desirable that all the air pass through the core and that none of it leak around the edges or perimeter of the air inlet face. Accordingly, a gasket is usually placed on the air inlet face, at or near the perimeter thereof, to press against a mating surface of the housing and thereby to provide a seal to prevent air leakage around the core. Such a gasket is shown in U.S. Pat. No. 4,083,400 as the combination of ceramic material 12 and plastic sealant material 14 in FIG. 1. If desired, plastic sealant material 14 could be replaced by compressible metal seal 70 shown in FIG. 7. However, as disclosed in U.S. Pat. No. 4,279,297, thermal cycling of the recuperator can result in leakage around the gasket because of differences in the coefficients of thermal expansion of the core, the gasket and the housing. This problem was solved in U.S. Pat. No. 4,279,297 by the use of compression means, specifically springs 28, to maintain a seal between the housing and the faces of the core having openings for gas flow. Thus, the prior art discloses the use of compression means on the four faces of the core which have openings for gas flow. The prior art does not suggest the use of compression means on the remaining two solid faces.

However, it has developed that there can be a problem with the recuperator disclosed in U.S. Pat. No. 4,279,297. If, say, operation of the recuperator becomes unbalanced by, for example, a sudden reduction in the flow of the air for combustion (which is usually room-temperature cool), there can be an unusual thermal stress placed on the core because of the hot exhaust gases which continue to flow therethrough, which can result in delamination or separation of the ribbed layers. Because of the nature of construction of the core, the separation of the ribbed layers occurs in a direction towards the solid faces. This invention alleviates such separation of ribbed layers by applying compressive force to the solid faces of the core.

A co-pending patent application Ser. No. 528,492, mailed Sept. 1, 1983. Abandoned, is also concerned with the same problem of separation of the ribbed layers and also discloses the application of compressive force solid faces of the core. However, the instant invention provides a simpler and less expensive means of applying the compressive force than is shown by the specific embodiment disclosed in said application. In the instant invention the compression means is contained within the housing.

In the drawings, FIG. 1 shows a cross-flow ceramic core comprised of ribbed layers and having four faces which have openings for gas flow and two faces which are solid.

Figure 1:
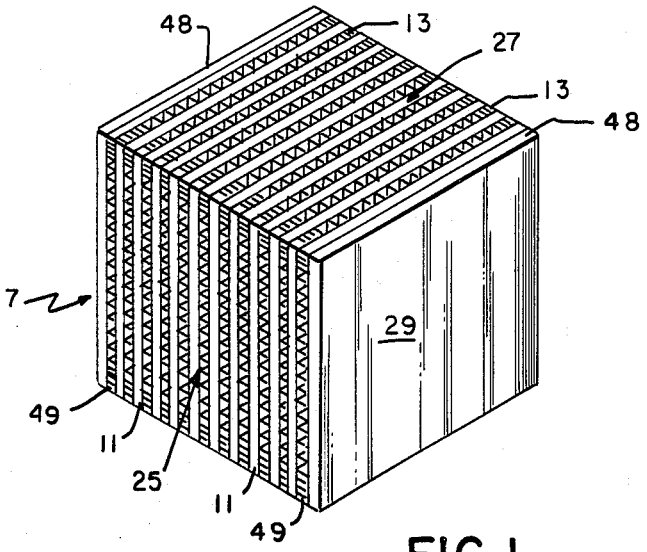
Figure 2:
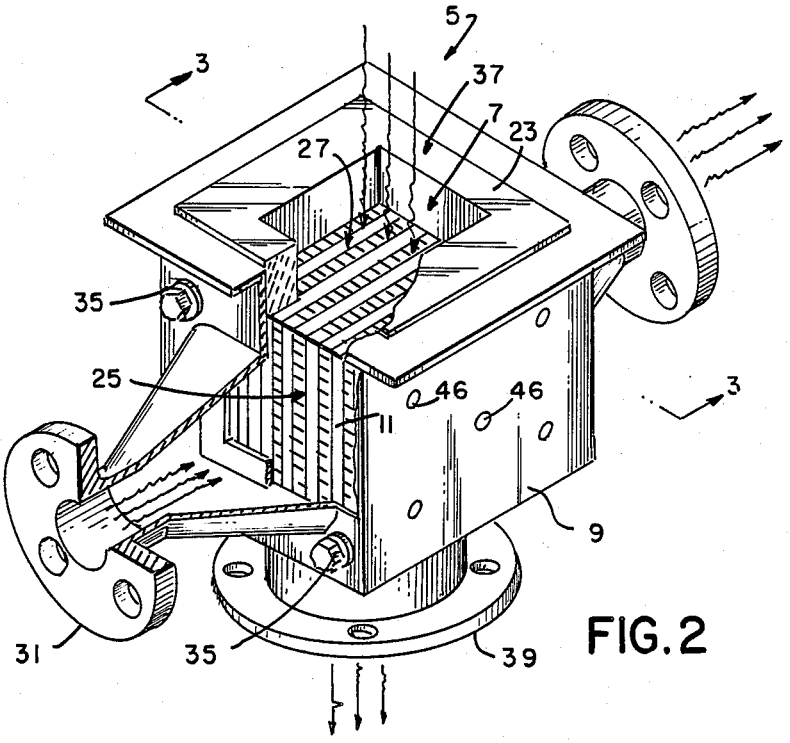
FIG. 2 is a perspective view, partially sectioned, of an embodiment of heat recuperative apparatus of this invention.

Shown in FIG. 2 is a partially sectioned perspective view of a preferred recuperator 5 including a ceramic cross-flow core 7 disposed within a housing 9. Ceramic cross-flow core 7 is preferably formed from a plurality of ribbed ceramic sheets stacked in a manner such that channelized layers 11 and 13 are alternated. The alternate layers 11 and 13 are sealed to one another to provide passages orthogonal to one another for conduction therethrough of first and second gases respectively.

Ceramic cross-flow core 7 may be formed by casting, molding, extruding or any one of a number of well-known techniques for forming ceramics as detailed in the previously-mentioned U.S. Pat. No. 4,130,160.

Housing 9 is preferably in the form of welded or drawn metal with a ceramic liner 23 affixed to the inner surface thereof and formed to accommodate ceramic cross-flow core 7. Thus, ceramic liner 23 serves to insulate metal housing 9 from the heat present at ceramic cross-flow core 7 during operation of the furnace, oven or calciner, for example. Also, ceramic cross-flow core 7 has first, second and third pairs of opposing faces, 25, 27 and 29 respectively.

The first pair of opposing faces 25 of core 7 includes passages therethrough for transmitting a first gas while housing 9 has flanged tapered portions 31 and 33 suitable for attachment to expedite flow of the first gas, e.g., combustion air, suitable to a furnace Also, a plurality of compression means 35 may be affixed to housing 9 to provide a compressive force to the pair of opposing faces 25.

The second pair of opposing faces 27 of core 7 includes passages therethrough for transmitting a second gas such as hot exhaust gases for example. The hot exhaust gases are utilized in the recuperator to heat the combustion air flowing through core 7. Also, housing 9 has an opening 37 of a size and configuration to permit entry of core 7 into housing 9 during assembly of recuperator 5. Hot exhaust gases flow through opening 37 into the openings on face 27 through core 7 out of opposing face 27 and out of flanged opening 39.

Figure 4:
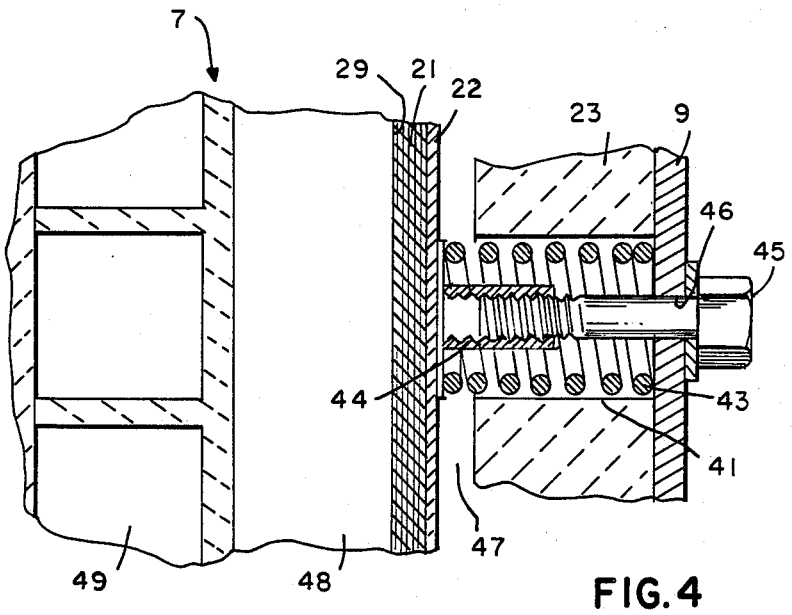
FIG. 4 is an enlarged illustration of a preferred form of compression means for applying a compressive force.

The third pair of opposing faces 29 of core 7 are solid, that is to say, faces 29 do not have openings for passage of gases therethrough. However, in accordance with this invention, compression is applied to faces 29. As can be seen in FIG. 4, a compressible member 21, for example, mullite paper, is located immediately adjacent each solid face 29. A support member 22, for example, a stainless steel plate, is in contact with each member 21. Faces 29 and members 21 and 22 have substantially the same area. Compressive means exert a compressive force on solid faces 29.

Figure 3:
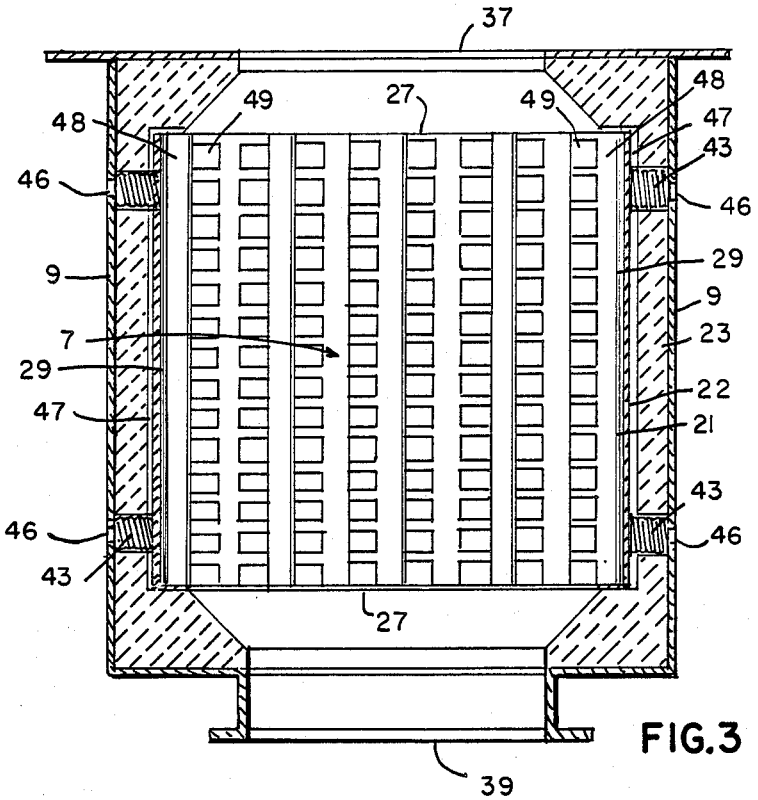
FIG. 3 is a cross-sectional view of FIG. 1, taken along the line 2—2.

One form of compression means is shown in FIGS. 3 and 4 and comprises a spring member 43, preferably a coiled spring, compressively held between plate 22 and housing 9 within an opening 41 through ceramic liner 23. In order to assemble the unit, a tubular coupling 44, internally threaded, is fastened, for example by welding, to plate 22. Coil 43 is then placed around coupling 44. Plate 22 is then placed against ceramic liner 23 with spring 43 within hole 41. A bolt 45, having a head thereon, is then placed through hole 46 in housing 9 and is threaded into coupling 44. Bolt 45 is then tightened to draw plate 22 toward ceramic liner 23 and to compress spring 43 between plate 22 and housing 9. After core 7 is inserted into housing 9, bolt 45 is completely unthreaded, thereby releasing spring 43, and permitting spring 43 to press plate 22 against compressible member 21 against solid face 29 of core 7. This usually leaves a narrow air gap 47 between plate 22 and ceramic liner 23, which helps reduce heat transfer from core 7 to spring 43.

In order to reduce the amount of heat that spring 43 is subjected to, and therefore to aid in maintaining springiness thereof during life, it is desirable to seal off the first channelized layer 48 next to each solid face 29 so that no gas passes through layer 48. Then, it is also desirable that in the adjacent channelized layer 49, the gas flow therethrough be that of the cool combustion air, instead of the hot exhaust gases.

A comparison was made between a recuperator having its solid faces under compression and the same recuperator without compression on the solid faces of the core. The core comprised a 12 inch cube. The passages for the combustion air were ⅛ inch high by ¾ inch wide. The passages for the hot exhaust gases were 0.3 inch high by ¾ inch wide. The temperature of the hot exhaust gas was 1650° F. and its rate of flow through the core was 10,000 SCFH. The manifold pressure was 16 ounces per square inch. The core was subjected to unusual thermal stress by suddenly reducing the flow of cool combustion air into the core to about 20% of its normal amount for about five minutes At the conclusion of the test the recuperator without compression on the solid faces of the core had a leakage of 54% and the layers of the core were found to be separated or delaminated. In contrast, the recuperator in accordance with this invention only had a leakage of 2.6% and the layers of the core did not separate or delaminate. It can be seen that the delaminating force was about 144 pounds, because the area of each layer was about 144 square inches and the manifold pressure was 16 ounces (1 pound) per square inch.

After bolts 45 are unthreaded and removed from housing 9, it is not necessary that holes 46 be filled or covered. It is usually desirable that a plurality of springs 43, say, three or five, be used on each plate 22 to distribute the compressive force throughout the area of plate 22.

I claim:

1. The method of making a ceramic cross-flow heat recuperator comprising a ceramic core within a housing wherein the core comprises ceramic ribbed layers with alternate layers being othogonal to each other, the spaces between ribs of each layer providing channels for the flow of gases therethrough, the core having three pairs of opposing faces, one pair of opposing faces having openings to provide for the flow into and out of the core of a gas to heated, the second pair of opposing faces having openings to provide for the flow into and out of the core of a hot gas, the third pair of faces being solid, the recupeerator additionally comprising a coiled spring for applying compressive force to a solid face, the coiled spring being disposed within the housing, the coiled spring being disposed between, and bearing against, the housing and a plate, the plate being disposed between the solid face and the ceramic liner, the plate transmitting the force exerted thereon by the spring to the solid face; the method comprising the step of drawing the plate toward the ceramic liner, thereby compressing the spring, in order to permit insertion of the core into the housing.

2. The method of claim 1 wherein the plate is drawn to the ceramic liner by the step of tightening a threaded bolt extending through the housing into a threaded coupling fastened to the plate.

* * * * *